US008316611B2

(12) United States Patent
Ellis et al.

(10) Patent No.: US 8,316,611 B2
(45) Date of Patent: Nov. 27, 2012

(54) PORTABLE SAFETY SKYLIGHT REPLACEMENT ASSEMBLY

(76) Inventors: J. Nigel Ellis, Wilmington, DE (US); John Witty, Richmond, VA (US)

( * ) Notice: Subject to any disclaimer, the term of this patent is extended or adjusted under 35 U.S.C. 154(b) by 0 days.

(21) Appl. No.: 13/354,017

(22) Filed: Jan. 19, 2012

(65) Prior Publication Data

US 2012/0137604 A1 Jun. 7, 2012

Related U.S. Application Data

(62) Division of application No. 12/259,020, filed on Oct. 27, 2008, now Pat. No. 8,122,673.

(60) Provisional application No. 60/983,163, filed on Oct. 27, 2007.

(51) Int. Cl.
*E04B 2/72* (2006.01)
*A47B 91/00* (2006.01)

(52) U.S. Cl. ..... 52/664; 52/200; 52/656.1; 52/663

(58) Field of Classification Search ..... 248/188.9, 248/677; 403/339; 5/625, 626, 627; 49/504; 52/79.9, 200, 202, 633, 645, 656.1, 660, 52/663, 664, DIG. 12
See application file for complete search history.

(56) References Cited

U.S. PATENT DOCUMENTS

| | | | | |
|---|---|---|---|---|
| 4,685,161 | A * | 8/1987 | Zalman | 5/627 |
| 5,343,660 | A * | 9/1994 | Caoduro et al. | 52/86 |
| D354,817 | S * | 1/1995 | Kovacs et al. | D25/48.8 |
| 5,502,934 | A * | 4/1996 | Coyne et al. | 52/200 |
| 6,164,697 | A * | 12/2000 | Riggs | 280/763.1 |
| 6,209,271 | B1 * | 4/2001 | Kovacs | 52/200 |
| 7,516,575 | B2 * | 4/2009 | Cuccurullo | 52/20 |

* cited by examiner

*Primary Examiner* — Brian Glessner
*Assistant Examiner* — Joseph J Sadlon
(74) *Attorney, Agent, or Firm* — Jordan IP Law, LLC

(57) ABSTRACT

A portable skylight replacement safety assembly that includes a first and second support frames releasably connected to each other and having a plurality of support handles and support members which extend substantially perpendicularly from the first support frame for supporting the first support frame on and/or over the skylight on a working surface at a predetermined distance.

20 Claims, 5 Drawing Sheets

PORTABLE SAFETY SKYLIGHT REPLACEMENT ASSEMBLY

CROSS-REFERENCE TO RELATED APPLICATIONS

The present application is a divisional of U.S. patent application Ser. No. 12/259,020 (filed Oct. 27, 2008), now U.S. Pat. No. 8,122,673, which claims priority to U.S. Provisional Patent Application No. 60/983,163 (filed on Oct. 27, 2007), which are each hereby incorporated by reference in their complete entireties.

BACKGROUND OF THE INVENTION

Skylights are often used in order to permit natural sunlight to enter into an interior space of a residential home, building, church and the like. Due to the relative spatial location of skylights and other roof openings, they create an occupational hazard. Fatalities and serious injuries have been related to falls through skylights and/or protective screening for skylights. For instance, impact falls have occurred from workers falling through unguarded skylight openings. Such falls have also occurred when conducting routine roof and/or skylight maintenance and replacing and/or providing protective screening for skylights.

Occupational Safety and Health Administration (OSHA) standard 29 CFR §1926.500(b)(4) requires that skylights be protected with railings and covers to protect against falls through a skylight/vent and/or a skylight/vent opening. In accordance with OSHA standard 29 CFR §1926.500(b)(4), if there is a danger of falling through a skylight, the skylight must be guarded with a standing railing or a cover strong enough to sustain the impact load of a person. In an attempt to meet the need to become OSHA compliant, various designs such as protective screens and railings have been employed. These devices, however, have proven inadequate or otherwise disadvantageous due to manufacturing costs and/or the lack of a robust structural design, and/or, the complexity of assembly/disassembly, and/or the lack of portability, and/or the lack of adequate space to permit maintenance be done to replace or install a skylight.

SUMMARY OF THE INVENTION

Embodiments relate to a portable skylight safety assembly which facilitates the replacement and/or installation of skylights, vents and the like and the addition of protective screening for skylights that are typically installed on flat roofs such as corrugated roofs of buildings, homes, churches and the like.

Embodiments relate to a portable safety assembly to provide protection against falls over skylights, skylight openings, floor openings, vent openings and other types of roof openings. The portable safety assembly is adaptable for all structural skylight models, such as flat, domed, circular, etc.

Embodiments relate to a portable skylight safety assembly that may include at least one of the following: a first support frame including a first support array having a plurality of parallel-spaced transverse members and a plurality of parallel-spaced longitudinal frame members, a plurality of first support handles, a plurality of support members extending substantially perpendicularly from the first support frame for supporting the first support frame over the skylight on a working surface, and a first releasable attachment mechanism provided on a distal one of the plurality of parallel-spaced transverse members; a second support frame including a second support array having a plurality of parallel-spaced transverse members and a plurality of parallel-spaced longitudinal frame members, and a second releasable attachment mechanism provided on a distal end of the second support frame for receiving the first releasable attachment mechanism to provide a releasable attachment or connection between the first support frame and the second support frame.

Embodiments relate to a portable skylight safety assembly that may include at least one of the following: a first support frame including a first support array having a plurality of parallel-spaced transverse members, a pair of parallel-spaced outer longitudinal frame members and an inner longitudinal frame member spaced in parallel from the outer longitudinal frame members; a first releasable attachment mechanism provided on the first support frame; a second support frame including a second support array having a plurality of parallel-spaced transverse members, a pair of parallel-spaced outer longitudinal frame members and an inner longitudinal frame member spaced in parallel from the outer longitudinal frame members; a second releasable attachment mechanism provided on the second support frame for receiving the first releasable attachment mechanism to provide a releasable attachment between the first support frame and the second support frame; a plurality of support handles extending from the first support frame and the second support frame; and a plurality of support members extending substantially perpendicularly from the first support frame and the second support frame for supporting the first support frame and the second support frame over the skylight on a working surface.

Embodiments relate to a portable skylight safety assembly that may include at least one of the following: a first support frame including a plurality of parallel-spaced transverse members, a pair of parallel-spaced outer longitudinal frame members and an inner longitudinal frame member spaced in parallel from the outer longitudinal frame members; a second support frame including a plurality of parallel-spaced transverse members, a pair of parallel-spaced outer longitudinal frame members and an inner longitudinal frame member provided between the outer longitudinal frame members; a releasable attachment mechanism for releaseably attaching the first support frame to the second support frame; and a plurality of support members for supporting the first support frame and the second support frame predetermined vertical distance above the skylight on a working surface.

In accordance with embodiments, the transverse members, the longitudinal members and the releasable attachment mechanism may be composed of at least one of a lightweight metal-based material, a lightweight composite material or a lightweight polymeric material. The metal-based material may be composed of aluminum. The lightweight nature facilitates the portability of the assembly by two persons. Once the two support frames are manipulated into an operating position, one may perform routine maintenance on a skylight, replacement of a skylight, routine roof repair and/or provide a protective screen over the skylights. The handles may be pivotable between a working position and a non-working position. The support members may displace the support frames (at a bottommost surface) thereof to a predetermined distance above a working surface in order to permit access to a skylight/vent in order to perform maintenance and/or replacement. This predetermined distance may be at least six inches.

Embodiments relate to an assembly that may include at least one of the following: a first support frame having fore and aft first support members spaced apart and extending substantially perpendicularly from the first support frame for supporting the first support frame on a working surface; a second support frame releasably connected to the first support frame and having fore and aft second support members spaced apart and extending substantially perpendicularly from the second support frame for supporting the first support frame on a working surface; and a plurality of support handles provided on the first and second support frames, wherein the support handles are pivotably moveable with respect to a respective one of the first and second support frames between a non-operating position and an operating position.

Embodiments relate to a portable skylight safety assembly that may include at least one of the following: a first support frame including a first support array having a plurality of parallel-spaced transverse members, a pair of parallel-spaced outer longitudinal frame members and an inner longitudinal frame member spaced in parallel from the outer longitudinal frame members; a first releasable attachment mechanism provided on the first support frame, wherein the first releasable attachment mechanism includes a hook member; a second support frame including a second support array having a plurality of parallel-spaced transverse members, a pair of parallel-spaced outer longitudinal frame members and an inner longitudinal frame member spaced in parallel from the outer longitudinal frame members; a second releasable attachment mechanism provided on the second support frame, wherein the second releasable attachment mechanism includes a bar that receives and engages the hook member of the first releasable attachment mechanism to releasable connect the first support frame to the second support frame; a plurality of pivotably moveable support handles provided on the first support frame and the second support frame; and a plurality of support members extending substantially perpendicularly from the first support frame and the second support frame for supporting the first support frame and the second support frame on a working surface.

Embodiments relate to a portable skylight safety assembly that may include at least one of the following: a first support frame including a mesh surface; a second support frame including a mesh surface; a plurality of support members for supporting the first support frame and the second support frame a predetermined vertical distance above a working surface; and a plurality of pivotably moveable support handles provided on the first support frame and the second support frame such that the support handles are pivotably moveable with respect to a respective one of the first and second support frames between a non-operating position on sidewalls of the first and second support frames and an operating position extending outwardly from a respective sidewall and in the same plane as the respective sidewall.

BRIEF DESCRIPTION OF THE DRAWINGS

Example

DETAILED DESCRIPTION OF EMBODIMENTS

Figure 1:
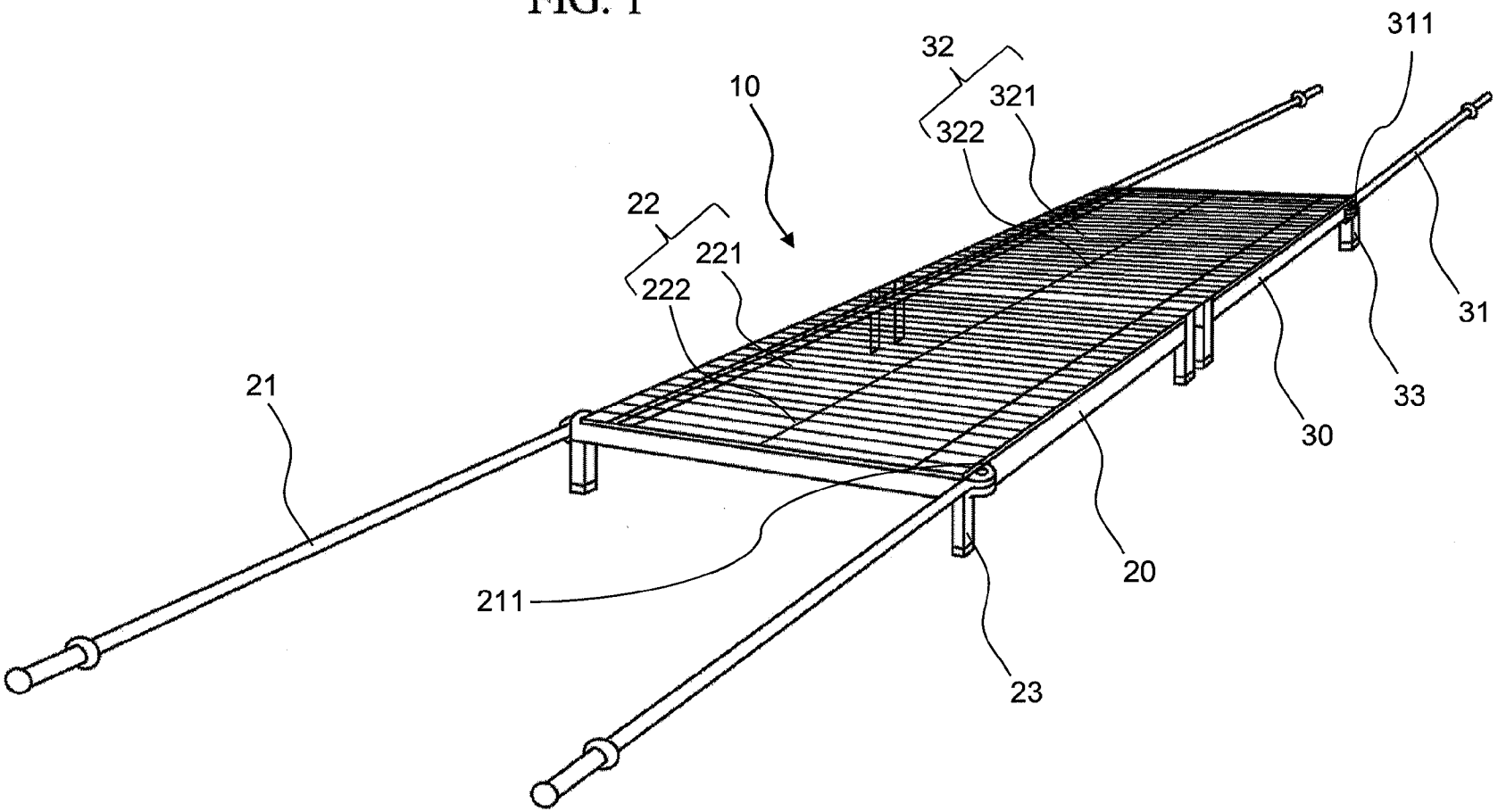
FIGS. 1-5 illustrate a portable skylight safety assembly in accordance with embodiments.
Figures 2A, 2B:
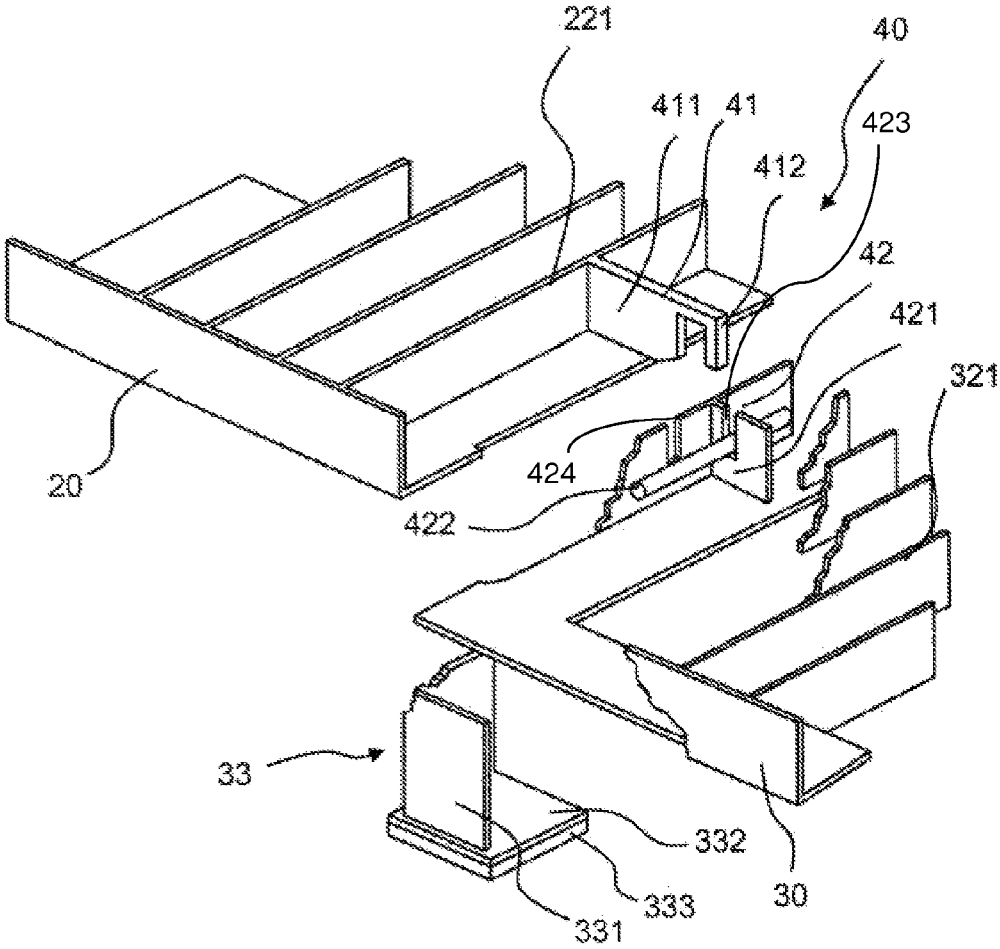
Figure 3:
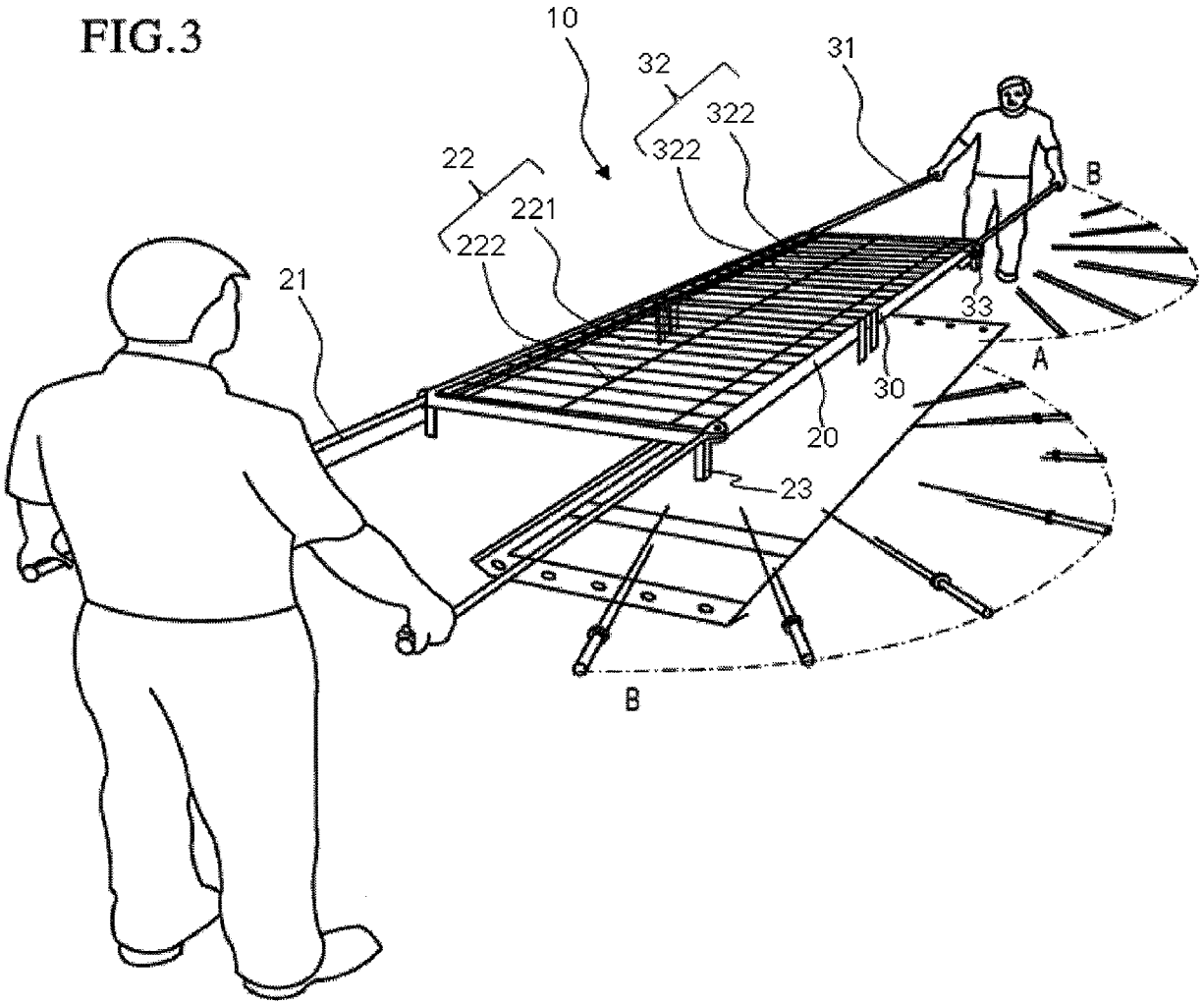

As illustrated in example FIGS. 1 to 3, in accordance with embodiments, a portable skylight change out assembly 10 is provided to permit one or more individuals to replace and/or install a skylight, vent and protective screening on and/or over a skylight in a safe manner. The skylight safety assembly 10 includes first support frame 20 which is removeably connected in an interlocking manner to second support frame 30 for placement on and/or over an opening or skylight. The support frames 20, 30 may be composed of lightweight yet structurally robust materials that can withstand an impact force of a worker. Such materials may be at least one of metal, polymer and composite materials. For example, if composed of a metal material, such material may be aluminum.

As illustrated in example FIG. 1, a bifurcated assembly 10 in accordance with embodiments may include first support frame 20 and second support frame 30 each having an array 22, 32 of support bars including a plurality of transverse frame members 221, 321 spaced apart in parallel to each other and a plurality of longitudinal frame members 222, 322 spaced apart in parallel and extending substantially perpendicularly to the transverse frame members 221, 321. The arrays 22, 32 may combine to have a planarized (i.e., flat and uniform) surface on and/or over the opening or skylight. The arrays 22, 32 may be composed of the same materials as support frame 20, 30. The arrays 22, 32 may be fixedly attached to the support frames 20, 30 are may alternatively be removeably inserted are attached at an opening in support frames 20, 30.

A plurality of support members 23, 33 extending substantially perpendicularly therefrom are provided for supporting support frame 20, 30 on and/or over an opening or skylight at a predetermined distance above the working surface. Such predetermined distance may be at least six inches. Support members 23, 33 may each include a leg member extending substantially perpendicularly from support frame 20, 30 and a foot member extending from the leg member. For example, the support member 33 includes a leg member 331 and a foot member 332 as shown in FIG. 2B. The foot member 332 actually physically contacts or otherwise abuts the working surface when support frame 20, 30 is positioned on and/or over an opening or a skylight. In accordance with embodiments, in order to maximize the resistance at an interface between the foot member 332 and the working surface, the foot member 332 includes a thin layer 333 formed at a bottommost surface thereof. The thin layer 333 is composed of a material (such as a diamond-based material) having a high coefficient of friction to provide enhanced slip resistance (i.e., maximum surface contact) when contacting the working surface.

As illustrated in example FIG. 2A and FIG. 2B. in accordance with embodiments first support frame 20 and second support frame 30 may be attached or connected to each other by locking mechanism 40 provided at a distal end of the plurality of parallel-spaced transverse members 221 and 321. Locking mechanism 40 may include a first releasable attachment mechanism 41 provided at a distal end of one of the transverse members 221 of support frame 20 and second releasable attachment mechanism 42 provided at a distal end of one of the transverse members 321 of support frame 30. First releasable attachment mechanism 41 may take the form of an extension member 411 extending substantially perpendicular to the transverse member 221. The extension member may be provided with a hook-type member 412 at a distal end thereof. Second releasable attachment mechanism 42 may take a bifurcated form that includes an extension member 421 extending substantially perpendicular from an uppermost surface of second support frame 30 and a sidewall of a distal one of the transverse members 321. Extension member 421 includes a slot 423 through which bar 422 extends substantially perpendicular therethrough. Bar 422 is sized to receive hook-type member 412 of the first releasable attachment mechanism 41. Particularly, the sidewall of the distal transverse member 321 of second support frame 30 includes a slot 424 sized to receive hook-type member 412. Slot 424 is spaced laterally from extension member 421 and enables hook-type member 412 to engage bar 422, which thereby effectuates the interlocking of the support frames 20, 30. Accordingly, first support frame 20 and second support frame 30 may be releaseably connected or attached to each other by latching the hook member 412 of first releasable attachment mechanism 41 to the bar 422 of second releasable attachment mechanism 42. The attachment may be released by merely manipulating first support member 20 upwardly relative to the working surface away from second support member 30.

As illustrated in example FIG. 3, each one of first support member 20 and second support member 30 has support handles 21, 31 provided to permit one or more persons to easily move assembly 10 from a non-working position to a working position, i.e., on and/or over an opening or skylight. Support handles 21, 31 are pivotably moveable with respect to a respective support frame 20, 30. Moreover, support handles 21, 31 laterally rotate about pivot end 211, 311 of a respective support handle along dotted line A-B of example FIG. 3. Particularly, in accordance with embodiments, each support handle 21, 31 is pivotably moveable and laterally rotates for manipulation between non-operating position "A" at a respective sidewall of support frame 20, 30 and an operating position "B" extending outwardly from support frame 20, 30 substantially along the same plane as a respective sidewall. Meaning, when manipulated into operating position "B," handles 21, 31 extend from the outer longitudinal sidewall of support frame 20, 30. Handles 21, 31 may have a length that enables one or more workers to lift assembly 10 and position the same on and/or over an opening or skylight without placing the worker at risk to fall through the opening, skylight or a weakened portion of the working surface adjacent to the opening or skylight. Handles 21, 31 may have a total length of six feet. Handles 21, 31 may also permit assembly 10 to be safely removed from the working position.

Figure 4:
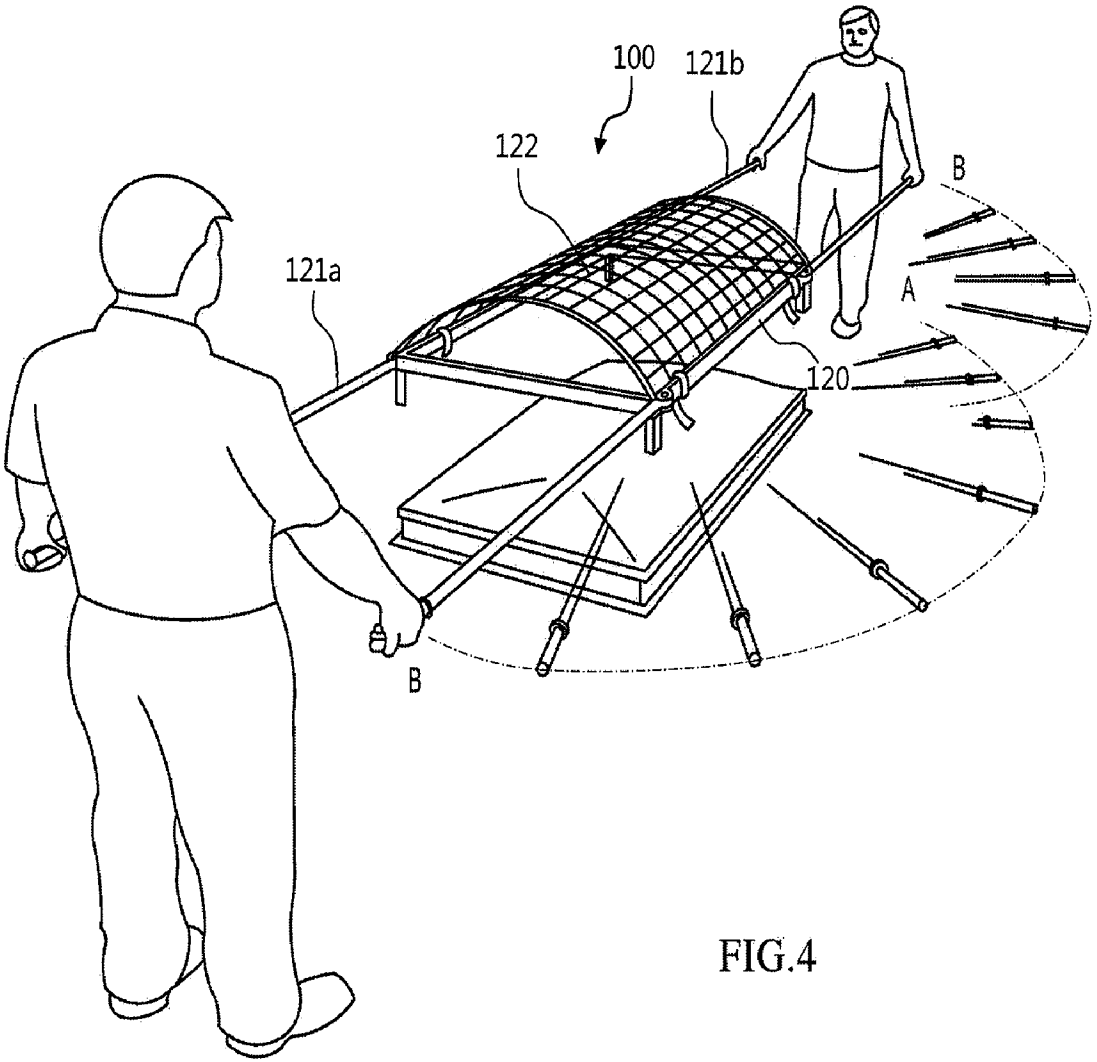
Figure 5:
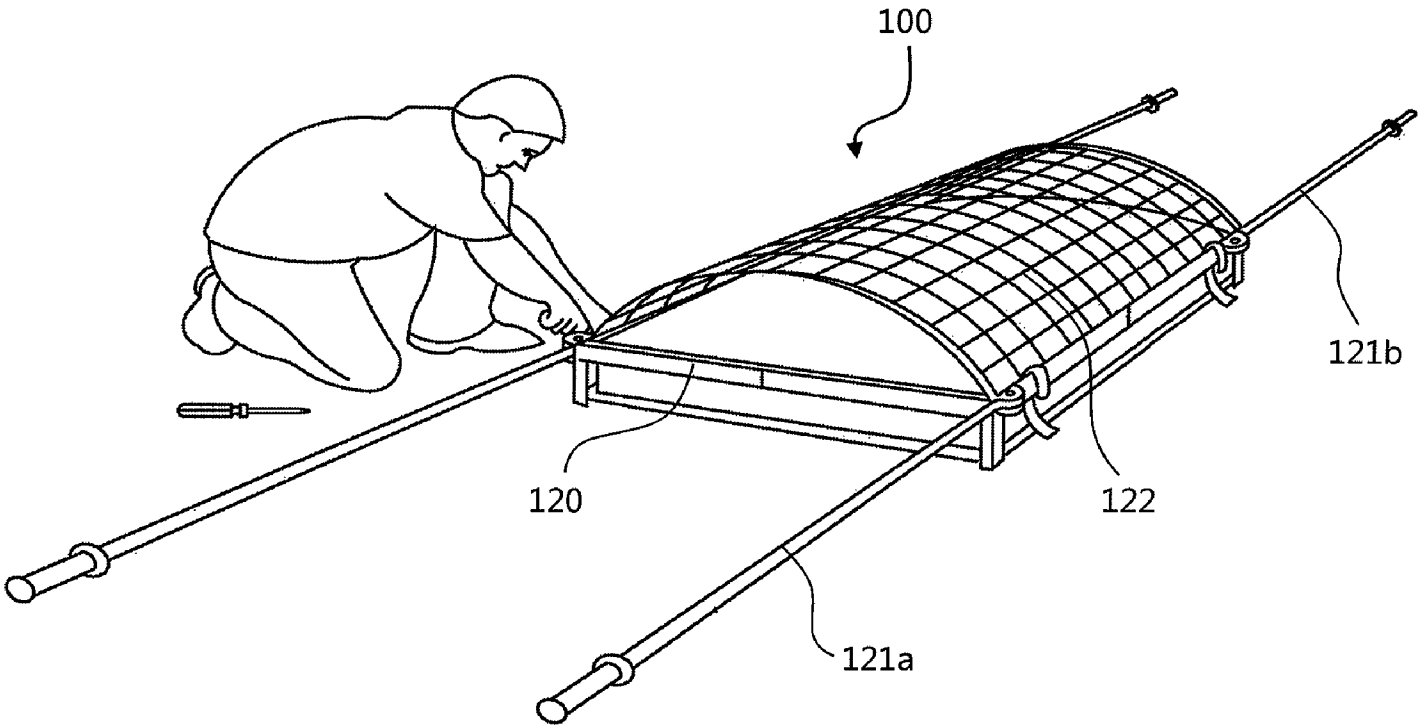

As illustrated in example FIGS. 4 and 5, assembly 100 in accordance with embodiments may have a unitary design structure including support frame 120 having an array of support bars 122 including a plurality of transverse frame members spaced apart in parallel to each other and a plurality of longitudinal frame members spaced apart in parallel and extending substantially perpendicularly to the transverse frame members. Support bars 122 may come in the form of a screen mesh or grid. Support bars 122 may combine to have an arcuate (semi-spherical) surface on and/or over the opening or skylight. Support bars 122 may be composed of the same materials as support frame 120, i.e., at least one of metal, polymer and composite materials.

As illustrated in example FIG. 4, support member 120 has support handles 121 on distal ends thereof for facilitating one or more persons to easily and quickly move assembly 10 from a non-working position to a working position, i.e., on and/or over an opening or skylight. Support handles 121 are pivotably moveable with respect to a respective support frame 120. For instance, support handles 121 are pivotably moveable for manipulation between non-operating position "A" at a respective sidewall of support frame 120 and an operating position "B" extending outwardly from support frame 120 substantially along the same plane as a respective sidewall. When manipulated into operating position "B," handles 121 extend from the outer longitudinal sidewall of support frame 120. Handles 21, 31 may have a length that enables one or more workers to safely lift assembly 10 and position the same on and/or over an opening or skylight without placing the worker at risk to fall through the opening, skylight or a weakened portion of the working surface adjacent to the opening or skylight. Handles 121 may have a total length of six feet. Handles 121 may also permit assembly 100 to be safely removed from the working position.

Accordingly, in accordance with embodiments, a portable skylight change out assembly is provided having a bifurcated or unitary design that offers protection against falls over skylights, skylight openings, floor openings, vent openings and other types of roof openings. The portable skylight change out assembly is composed of lightweight materials, and thus, is easily transportable by one or more persons. Due to its lightweight, the assembly does not impose undue loads on and/or an opening or skylight that would place a worker at risk when installing, replacing or repairing a roof skylight. A pair of support handles are provided at distal ends of the assembly to permit one or more workers to safely transport and position the assembly on and/or over skylights, skylight openings, floor openings, vent openings and other types of roof openings.

Although embodiments have been described herein, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art

What is claimed is:

1. A portable skylight safety assembly comprising:

a support base configured for placement a predetermined vertical distance above a working surface, the support base having a plurality of sidewalls and a support surface positioned interior to the sidewalls and configured for placement over a skylight, the support surface having an arcuate-shaped surface which includes a plurality of parallel-spaced transversely extending members and a plurality of parallel-spaced longitudinally extending base members which extend substantially perpendicularly to the parallel-spaced transversely extending members;

a pair of first support handles each having a first pivot end pivotably connected to the support base such that each of the first support handles rotate laterally on the first pivot end thereof between a non-operation position and an operation position; and a pair of second support handles each having a second pivot end pivotably connected to the support base such that each of the second support handles rotate laterally on the second pivot end thereof between a non-operation position and an operation position.

2. The portable skylight safety assembly of claim 1, wherein the predetermined distance is at least six inches.

3. The portable skylight safety assembly of claim 1, wherein the support base is configured for placement around the peripheral surface of the skylight.

4. The portable skylight safety assembly of claim 1, wherein the support base is composed of at least one of a metal-based material, a composite material and a polymeric material.

5. The portable skylight safety assembly of claim 4, wherein the metal-based material comprises aluminum.

6. The portable skylight safety assembly of claim 1, wherein the support surface is composed of at least one of a metal-based material, a composite material and a polymeric material.

7. The portable skylight safety assembly of claim 6, wherein the metal-based material comprises aluminum.

8. The portable skylight safety assembly of claim 1, further comprising a plurality of support members configured to support the support base the predetermined vertical distance above the working surface.

9. The portable skylight safety assembly of claim 8, wherein the support members each comprise:

a leg member extending substantially perpendicularly from the support frame; and a foot member extending from the leg member and configured to contact the working surface when the support frame is positioned on the working surface.

10. The portable skylight safety assembly of claim 9, further comprising a support layer provided at a bottommost surface of the foot member and which is configured to frictionally engage the working surface when support frame is positioned on the working surface.

11. A portable skylight safety assembly provided to permit at least one of a replacement and installation of a skylight, vent and protective screening over a skylight, said portable skylight safety assembly comprising:

a support base having first and second lateral sidewalls spaced apart and front and rear sidewalls spaced apart and extending between the lateral sidewalls to define a support area over the skylight, and a plurality of support bars provided at the support area to define a support surface having an arcuate-shaped surface;

first support handles having a first pivot end pivotably connected to the support base such that each of the first support handles rotate laterally on the first pivot end thereof between a non-operation position on the first lateral sidewall, respectively and an operation position extending outwardly from the support base substantially along the same plane as the first lateral sidewall; and second support handles having a second pivot end pivotably connected to the support base such that each of the second support handles rotate laterally on the second pivot end thereof between a non-operation position on the second lateral sidewall and an operation position extending outwardly from the support base substantially along the same plane as the second lateral sidewall, wherein the first and second support handles each have a length of 6 feet.

12. The portable skylight safety assembly of claim 11, further comprising a plurality of support members configured to support the support base the predetermined vertical distance above the working surface.

13. The portable skylight safety assembly of claim 12, wherein the support members each comprise:

a leg member extending substantially perpendicularly from the support frame; and a foot member extending from the leg member and configured to contact the working surface when the support frame is positioned on the working surface.

14. The portable skylight safety assembly of claim 13, further comprising a support layer provided at a bottommost surface of the foot member and which is configured to frictionally engage the working surface when the support frame is positioned on the working surface.

15. The portable skylight safety assembly of claim 11, wherein the support base and the support surface are each composed of at least one of a metal-based material, a composite material and a polymeric material.

16. The portable skylight safety assembly of claim 15, wherein the metal-based material comprises aluminum.

17. A portable skylight safety assembly provided to permit at least one of a replacement and installation of a skylight, vent and protective screening over a skylight, said portable skylight safety assembly comprising:

a support base configured for placement on a working surface and around a peripheral surface of the skylight, the support base having first and second lateral sidewalls spaced apart, front and rear sidewalls spaced apart and extending between the lateral sidewalls to define a support area over the skylight, a plurality of parallel-spaced transversely extending members and a plurality of parallel-spaced longitudinally extending base members which extend substantially perpendicularly to the parallel-spaced transversely extending members to define a support surface at the support area, said support surface having an arcuate-shaped surface;

first support handles each being six feet in length and configured to rotate laterally about a first pivot end thereof with respect to the support base between a non-operation position on the first lateral sidewall, respectively and an operation position extending outwardly from the support base substantially along the same plane as the first lateral side all;

second support handles each being six feet in length and configured to rotate laterally about a second pivot end thereof with respect to the support base between a non-operation position on the second lateral sidewall, respectively and an operation position extending outwardly from the support base substantially along the same plane as the second lateral sidewall;

first support members provided at a first end of the support base adjacent the first support handles and configured to support the support base above the working surface; and second support members provided at a second end of the support base adjacent the second support handles and configured to support the support base above the working surface.

18. The portable skylight safety assembly of claim 17, wherein the first and second support members each comprise:

a leg member extending substantially perpendicularly from the support frame;

a foot member extending from the leg member and configured to contact the working surface when the support frame is positioned on the working surface; and a support layer provided at a bottommost surface of the foot member and which is configured to frictionally engage the working surface when the support frame is positioned on the working surface.

19. The portable skylight safety assembly of claim 17, wherein the support base and the support surface are each composed of at least one of a metal-based material, a composite material and a polymeric material.

20. The portable skylight safety assembly of claim 19, wherein the metal-based material comprises aluminum.

* * * * *

UNITED STATES PATENT AND TRADEMARK OFFICE

CERTIFICATE OF CORRECTION

PATENT NO. : 8,316,611 B2
APPLICATION NO. : 13/354017
DATED : November 27, 2012
INVENTOR(S) : Ellis et al.

It is certified that error appears in the above-identified patent and that said Letters Patent is hereby corrected as shown below:

On the Title Page, item [76], the name of the second inventor should read:

--John Whitty, Richmond, VA (US)--

Signed and Sealed this
Sixth Day of January, 2015

Michelle K. Lee

Michelle K. Lee
*Deputy Director of the United States Patent and Trademark Office*